US011638082B2

(12) United States Patent
Lu et al.

(10) Patent No.: US 11,638,082 B2
(45) Date of Patent: Apr. 25, 2023

(54) EARPHONE WITH DETACHABLE ADD-ON UNIT

(71) Applicant: DEXIN CORP., New Taipei (TW)

(72) Inventors: Ho Lung Lu, New Taipei (TW); Ya-Hsiu Tsai, New Taipei (TW)

(73) Assignee: DEXIN CORP., New Taipei (TW)

( * ) Notice: Subject to any disclaimer, the term of this patent is extended or adjusted under 35 U.S.C. 154(b) by 0 days.

(21) Appl. No.: 17/514,714

(22) Filed: Oct. 29, 2021

(65) Prior Publication Data

US 2022/0303659 A1 Sep. 22, 2022

Related U.S. Application Data

(60) Provisional application No. 63/162,608, filed on Mar. 18, 2021.

(51) Int. Cl.
*H04R 1/10* (2006.01)
*H01F 7/02* (2006.01)

(52) U.S. Cl.
CPC ..... *H04R 1/1016* (2013.01); *H04R 1/1025* (2013.01); *H01F 7/02* (2013.01)

(58) Field of Classification Search
CPC ..... H04R 1/1016; H04R 1/1025; H04R 1/08; H04R 1/083; H01F 7/02
See application file for complete search history.

(56) References Cited

U.S. PATENT DOCUMENTS

| | | | | |
|---|---|---|---|---|
| 9,742,890 | B2 * | 8/2017 | Gibbons | H04R 1/1041 |
| 10,241,750 | B1 * | 3/2019 | Ralston, Jr. | H04B 1/3827 |
| 2009/0268935 | A1 * | 10/2009 | Dillinger | H04R 1/1075 381/371 |
| 2012/0041581 | A1 * | 2/2012 | Lee | H04R 1/1033 700/94 |
| 2018/0234532 | A1 * | 8/2018 | Meyberg | H04R 1/1066 |
| 2021/0038161 | A1 * | 2/2021 | Stephenson | A61B 5/0059 |
| 2022/0029456 | A1 * | 1/2022 | Leung | H04R 1/1041 |

* cited by examiner

*Primary Examiner* — Jason R Kurr
(74) *Attorney, Agent, or Firm* — Maschoff Brennan

(57) ABSTRACT

An earphone is provided, the earphone includes a main body and an add-on unit, and the add-on unit is removably disposed on the main body using magnetic attraction force.

12 Claims, 6 Drawing Sheets

EARPHONE WITH DETACHABLE ADD-ON UNIT

CROSS-REFERENCE TO RELATED APPLICATIONS

This application claims the priority benefits of U.S. provisional application Ser. No. 63/162,608, filed on Mar. 18, 2021. The entirety of each of the above-mentioned patent applications is hereby incorporated by reference herein.

TECHNICAL FIELD

The disclosure relates to a wearable device, more particularly to an earphone with a detachable add-on unit.

BACKGROUND

Wireless earphones can bring a lot of conveniences as they set users free from any cables or wires. In addition to the basic needs of users such as listening to music, the earphone may have a microphone for collecting sound.

It is known that the built-in microphone of wireless earphones is arranged inside the earphone shell and is located away from the user's mouth while using, thus this type of earphone is unable to have a quality voice pick-up but easily collect ambient noise.

SUMMARY

One embodiment of the disclosure provides an earphone, the earphone includes a main body and an add-on unit, and the add-on unit is removably disposed on the main body using magnetic attraction force.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
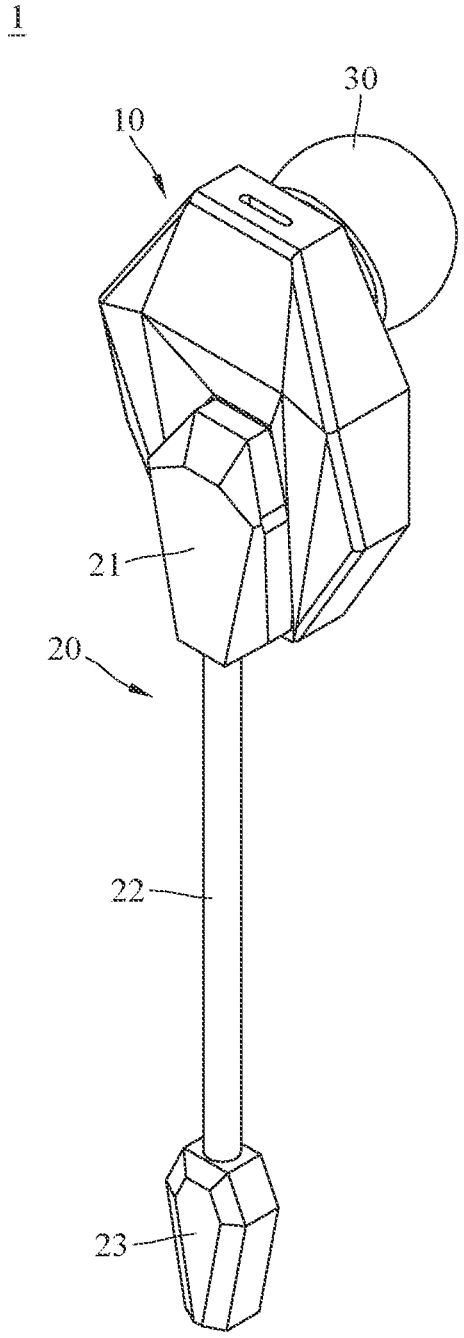
FIG. 1 is a perspective view of an earphone according to one embodiment of the disclosure.

The following embodiments will be described with reference to the drawings. For the purpose of clear illustration, some features shown in the drawings may be illustrated in a simplified manner or slightly exaggerated but are not intended to limit the disclosure. Unless explicitly stated, the term "at least one" as used herein may mean that the quantity of the described element or component is one or more than one but does not necessarily mean that the quantity is only one. The term "and/or" may be used herein to indicate that either or both of two stated possibilities.

Figure 2:
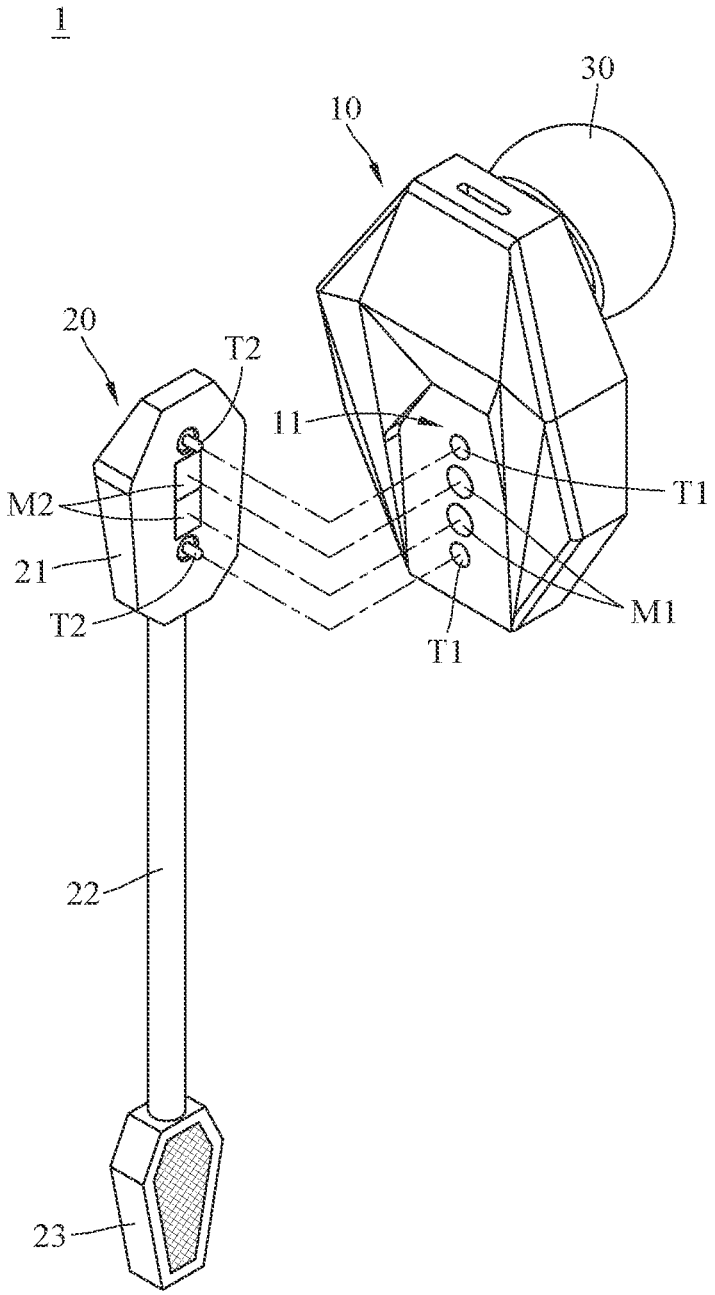
FIG. 2 is an exploded view of the earphone in FIG. 1.

Firstly, referring to FIGS. 1-2, an earphone 1 is provided, the earphone 1 may include a main body 10 and an in-ear eargel 30. Selectively, the earphone 1 may have a microphone assembly 20 removably attached to the main body 10 thereof.

The main body 10 is, but not limited to, the right or left audio device of a true wireless stereo (TWS) Bluetooth earphone. The term "TWS" or "True wireless stereo" refers to a technology that allows two audio devices to be paired via Bluetooth, realizing the wireless separation of real Bluetooth left and right sound channels.

The in-ear eargel 30 is attached or connected to one side of the main body 10. The in-ear eargel 30 is made of, for example, silicone, sponge, urethane, or the like and is shaped and sized to be insertable in the external ear canal. Note that the shape, size, and the material of the in-ear eargel 30 all may be modified as required and are not intended to limit the disclosure. In another embodiment, the earphone may omit the in-ear eargel; in this case, part of the main body may be sized and shaped to be insertable in the external ear canal.

The microphone assembly 20 is removable to the main body 10 and therefore can be served as an optional add-on unit or device. The microphone assembly 20 may include a mount portion 21, an extension portion 22, and a microphone 23. The mount portion 21 is configured to be attached to the main body 10. As shown, the main body 10 may have an accommodation portion 11, the accommodation portion 11 may be a recess recessed from the outer surface of the main body 10 and in a shape mating the contour of the mount portion 21 so that the accommodation portion 11 is able to accommodate at least part of the mount portion 21. The mating shape of the mount portion 21 and the accommodation portion 11 may have foolproof design.

The extension portion 22 extends outwards from the mount portion 21, the microphone 23 is disposed at one end of the extension portion 22 and is connected to the mount portion 21 via the extension portion 22. The extension portion 22 may be made of any suitable flexible material. The extension portion 22 keeps the microphone 23 close to the user's mouth to have a quality voice pick-up. Note that the length and size of the extension portion 22 may be modified as required.

Figure 3:
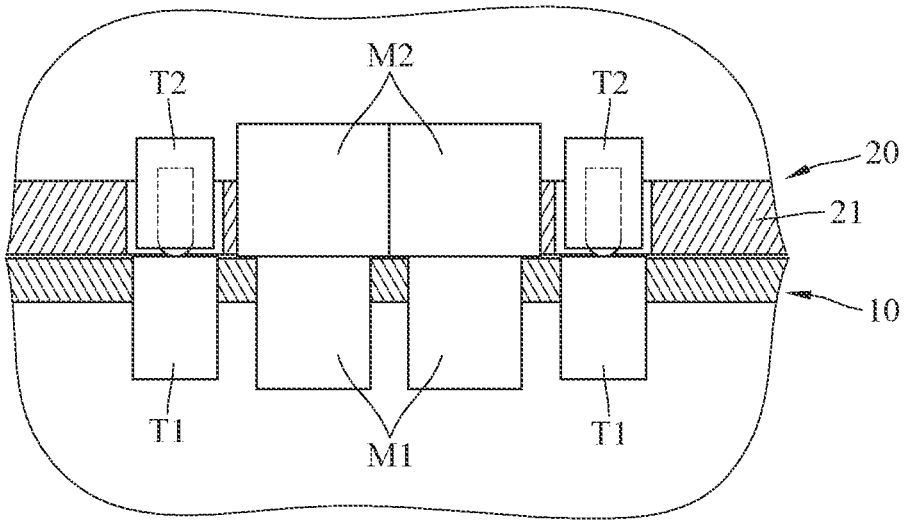
FIG. 3 is a partially enlarged view showing the connection between a main body of the earphone and a microphone assembly.

In this embodiment, the mount portion 21 may be attached to the main body 10 using magnetic attraction force. Please refer to FIGS. 2-3, in this embodiment, the earphone 1 may further include at least one first magnet M1, at least one second magnet M2, at least one first terminal T1, and at least one second terminal T2. The first magnets M1 and the second magnets M2 may be made of any suitable ferromagnetic material. The first terminals T1 and the second terminals T2 may be, but is not limited to, any suitable pogo pin connector typically used for signal transmission, which has the advantages of small size and high reliability.

The first magnets M1 and the first terminals T1 are arranged at the accommodation portion 11 of the main body 10, and the second magnets M2 and the second terminals T2 are arranged at the mount portion 21 of the microphone assembly 20. When the mount portion 21 is arranged at the accommodation portion 11, the first magnets M1 respectively correspond to the second magnets M2, the first magnets M1 and the mating second magnets M2 are in opposite poles so as to firmly attract and pull the microphone assembly 20 towards the main body 10. When the first magnets M1 respectively correspond to the second magnets M2, the first terminals T1 are respectively electrically connected to the second terminals T2 to enable the signal and electricity transmission between the microphone assembly 20 and the main body 10. As such, the attraction force caused by the first magnets M1 and the second magnets M2 enables a fast and precise installation of the microphone assembly 20 to the main body 10. Even when the mount portion 21 is not perfectly placed in the accommodation portion 11, the magnetic attraction force between the first magnets M1 and the second magnets M2 still able to pull the microphone assembly 20 to the required position to ensure the electrical connection between the first terminals T1 and the second terminals T2.

On the other hand, the arrangement of the first magnets M1 and the second magnets M2 enables a fast removal of the microphone assembly 20 from the main body 10 without affecting the functions of the main body 10.

As shown, the first magnets M1 and the first terminals T1 are arranged along a straight line, and the first magnets M1 are arranged between the first terminals T1. The second magnets M2 and the second terminals T2 are arranged along a straight line, and the second magnets M2 are arranged between the second terminals T2. In other embodiments, the first magnets M1, the second magnets M2, the first terminals T1, and the second terminals T2 may be in any required quantity and arrangement.

For example, the first magnets M1 and the first terminals T1 may be arranged in a cross-shaped array, and the second magnets M2 and the first terminals T1 may be arranged in a mating array; alternatively, the main body 10 may only have one first magnet M1 and one first terminal T1 thereon, and the mount portion 21 may only have one second magnet M2 and one second terminal T2 thereon. In addition, optionally, the first magnets M1 and the second magnets M2 may each have an iron yoke to further focus the magnetic field.

Figure 4:
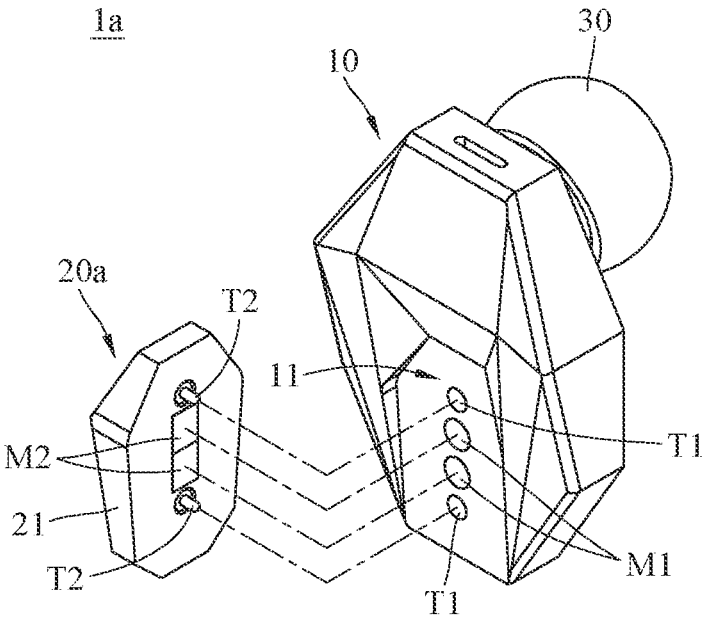
FIG. 4 is an exploded view of a main body and a battery unit of an earphone according to another embodiment of the disclosure.

Note that the microphone assembly 20 is one of exemplary add-on units suitable for the main body 10. Please see an earphone 1*a* shown in FIG. 4, an add-on unit 20*a* suitable for the main body 10 of the earphone 1*a* may be a battery unit (may be called "battery unit 20*a*" hereinafter). The battery unit 20*a* may contain any typical battery (not shown) suitable for charging earphone. The aforementioned arrangements of the first magnets M1, the first terminals T1, the second magnets M2, and the second terminals T2 may be applied to the battery unit 20*a* and the main body 10 to enable a fast installation of the battery unit 20*a*. When the first magnets M1 and the second magnets M2 attract to each other to fix the battery unit 20*a* to the main body 10, the first terminals T1 are electrically connected to the second terminals T2 so that the battery unit 20*a* is able to transmit electricity to the main body 10 via the first terminals T1 and the second terminals T2.

Figure 5:
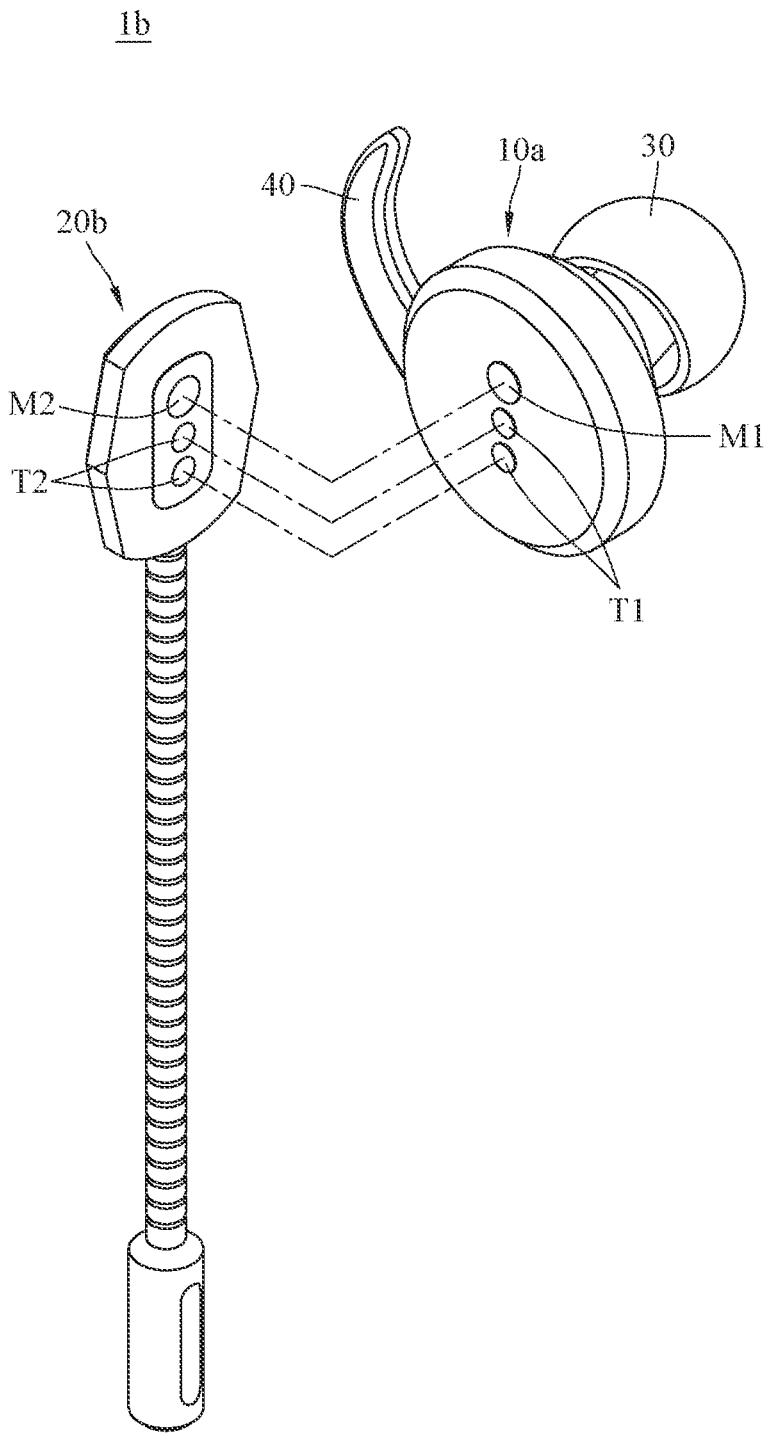
FIG. 5 is an exploded view of a main body and an add-on unit of an earphone according to still another embodiment of the disclosure.

Then, please see an earphone 1*b* shown in FIG. 5, as shown, the earphone 1*b* may have an add-on unit 20*b* having similar or the same function to that of the aforementioned microphone assembly 20, the add-on unit 20*b* and the main body 10*a* may be electrically connected to each other via the first terminals T1 and the second terminals T2 while having only one pair of magnets (e.g., one first magnet M1 and one second magnet M2) inbetween.

In addition, as shown, optionally, there is a stabilizer 40 arranged on the main body 10*a*. The stabilizer 40 may be made of any suitable plastic or metal material. The stabilizer 40 may be additionally disposed on the main body 10*a* or integrally formed with the main body 10*a*. The stabilizer 40 extends outwards from the main body 10*a* and is configured to press against or abut the user's conchal wall to stabilize and secure the earphone 1*b* in the ear and prevents it from falling out of the ear. Note that the stabilizer 40 enables reliable wearing even when the add-on unit 20*b* is attached to the main body 10*a*.

Figure 6:
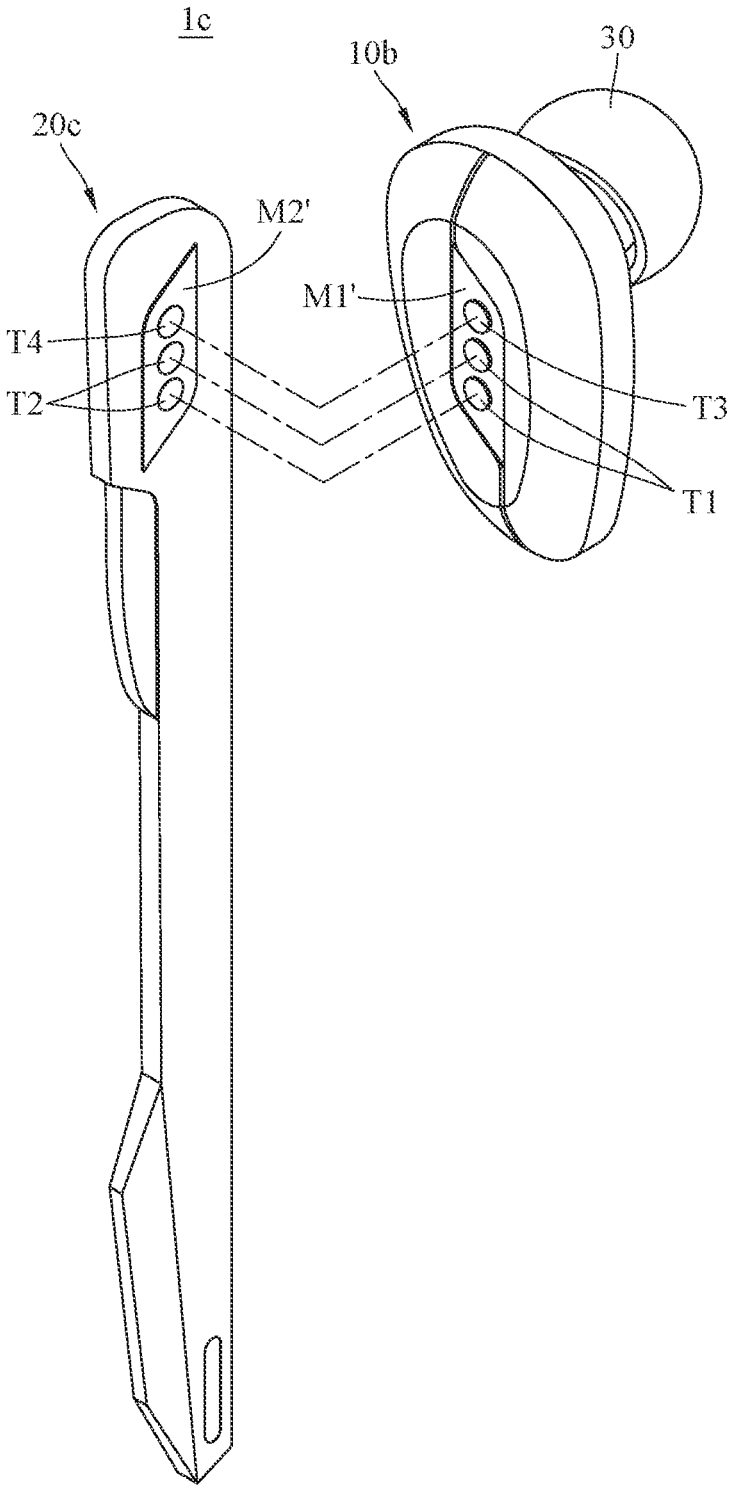
FIG. 6 is an exploded view of a main body and an add-on unit of an earphone according to yet another embodiment of the disclosure.

Alternatively, please see an earphone 1*c* shown in FIG. 6, as shown, the earphone 1*c* may have an add-on unit 20*c* having similar or the same function to that of the aforementioned microphone assembly, and the add-on unit 20*c* and the main body 10*b* may be electrically connected to each other via the first terminals T1 and the second terminals T2 while having only one pair of magnets (e.g., one first magnet M1 and one second magnet M2) inbetween. In addition, the main body 10*b* may have at least one built-in microphone (not shown) therewithin. When the add-on unit 20*c* is attached to the main body 10*b*, the built-in microphone in the main body 10*b* may be deactivated. In more detail, the earphone 1*c* may further include a third terminal T3 and a fourth terminal T4, the third terminal T3 and the fourth terminal T4 are respectively arranged at the main body 10*b* and the add-on unit 20*c*, when the add-on unit 20*c* is attached to the main body 10*b*, the third terminal T3 is electrically connected to the fourth terminal T4 so as to cause the built-in microphone in the main body 10*b* to be deactivated and cause the add-on unit 20*c* to be activated, thereby instantly switching the microphone in use by the earphone 1*c*.

Note that the first terminals T1, the third terminal T3, the second terminals T2, and the fourth terminal T4 may be in any other suitable arrangement as required. In addition, in this embodiment, the magnets are arranged at the periphery of the terminals of the main body 10*b* and the add-on unit 20*c*, as shown, the main body 10*b* has a first magnet M1' surrounding the first terminals T1 and the third terminal T3, and the add-on unit 20*c* has a second magnet M2' surrounding the second terminals T2 and the fourth terminal T4.

Figure 7:
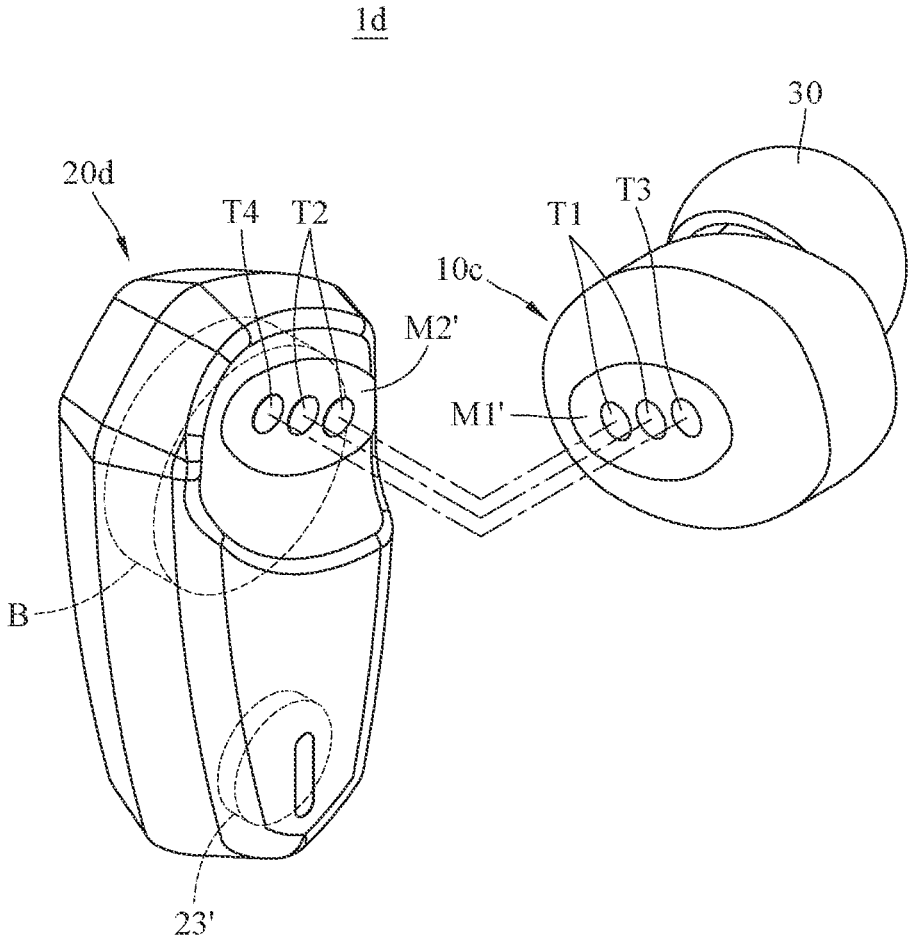
FIG. 7 is an exploded view of a main body and an add-on unit of an earphone according to yet still another embodiment of the disclosure.

Alternatively, please see an earphone 1*d* shown in FIG. 7, a main body 10*c* and an add-on unit 20*d* of the earphone 1*d* may be attached to and electrically connected to each other by any one of the aforementioned manners. The add-on unit 20*d* may accommodate a microphone 23' and a battery B therewithin. The microphone 23' may be any suitable microphone typically used in an earphone; the battery B may be any typical battery suitable for charging earphone. In other words, the add-on unit 20*d* combines the functions of the microphone and battery. When the add-on unit 20*d* is attached to the main body 10*c*, the add-on unit 20*d* can be served as a microphone and also served as a charger to provide electricity to the main body 10*c*.

Note that the stabilizer 40 mentioned in the previous embodiment can be applied to the earphone 1*d*. In addition, to further secure the installation of the add-on unit 20*d*, in one embodiment, the shells of the main body 10*c* and the add-on unit 20*d* may have mating structures, such as protrusion and recess or outer and inner threads (not shown).

According to the earphones as discussed in the above embodiments, the add-on unit is removably disposed on the main body of the earphone using magnetic attraction force, which allows user to quickly add required function or module (e.g., microphone and/or battery) to the earphone.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. An earphone, comprising:

a main body;

an add-on unit, removably disposed on the main body using magnetic attraction force;

two first terminals arranged at the main body;

two first magnets arranged at the main body and arranged between the two first terminals;

two second terminals arranged at the add-on unit; and two second magnets arranged at the add-on unit and arranged between the two second terminals.

2. The earphone according to claim 1, wherein the add-on unit is attached to the main body through a magnetic attraction produced between the two first magnets and the two second magnets.

3. The earphone according to claim 2, wherein the add-on unit comprises a mount portion, an extension portion, and a microphone, the two second magnets are arranged at the mount portion, the microphone is connected to the mount portion via the extension portion and located away from the main body.

4. The earphone according to claim 3, wherein the main body has an accommodation portion, the two first magnets are located in the accommodation portion, and at least part of the mount portion is accommodated in the accommodation portion.

5. The earphone according to claim 1, wherein when the add-on unit is attached to the main body via the two first magnets and the two second magnets, the two first terminals are electrically connected to the two second terminals.

6. The earphone according to claim 5, wherein the two first magnets comprise opposite poles, and the two second magnets comprise opposite poles.

7. The earphone according to claim 5, wherein the add-on unit is a battery unit configured to charge the main body through the two first terminals and the two second terminals.

8. The earphone according to claim 5, further comprising a third terminal and a fourth terminal, the third terminal is arranged at the main body, the fourth terminal is arranged at the add-on unit, when the third terminal is electrically connected to the fourth terminal, a built-in microphone in the main body is turned off.

9. The earphone according to claim 1, wherein the two first magnets and the two first terminals are arranged along a straight line, the two second magnets and the two second terminals are arranged along a straight line.

10. The earphone according to claim 1, further comprising an in-ear eargel disposed on the main body.

11. The earphone according to claim 1, further comprising a stabilizer disposed on the main body and extending outwards from the main body.

12. The earphone according to claim 1, wherein the add-on unit accommodates at least one microphone and a battery therewithin.

* * * * *